US007959227B2

(12) United States Patent
Miller

(10) Patent No.: US 7,959,227 B2
(45) Date of Patent: Jun. 14, 2011

(54) KNIT FORM-FIT SLIPCOVER FOR A RECLINER

(75) Inventor: Brenda Kay Miller, Jersey Shore, PA (US)

(73) Assignee: Sure Fit Inc., Allentown, PA (US)

( * ) Notice: Subject to any disclaimer, the term of this patent is extended or adjusted under 35 U.S.C. 154(b) by 0 days.

(21) Appl. No.: 12/206,019

(22) Filed: Sep. 8, 2008

(65) Prior Publication Data

US 2008/0315642 A1 Dec. 25, 2008

Related U.S. Application Data

(63) Continuation-in-part of application No. 11/285,916, filed on Nov. 23, 2005, now Pat. No. 7,422,281.

(60) Provisional application No. 60/976,204, filed on Sep. 28, 2007.

(51) Int. Cl.
*A47C 31/11* (2006.01)

(52) U.S. Cl. ..... 297/224; 297/225; 297/228; 297/228.1; 297/228.12; 297/229

(58) Field of Classification Search ..... 297/219.1, 297/224, 225, 226, 228, 228.1, 228.11, 228.12, 297/229
See application file for complete search history.

(56) References Cited

U.S. PATENT DOCUMENTS

| | | | |
|---|---|---|---|
| 1,825,909 | A | 10/1931 | Levi |
| 1,942,111 | A | 1/1934 | Levi |
| 2,083,236 | A | 6/1937 | Levi |
| 2,086,640 | A | 7/1937 | Reynolds |
| 2,098,684 | A | 11/1937 | Fry |
| 2,100,868 | A | 11/1937 | Oppenheimer |
| 2,123,667 | A | 7/1938 | Trubitz |
| 2,183,828 | A | 12/1939 | Trubitz |
| 2,305,359 | A | 6/1944 | Krasnov et al. |
| 2,839,127 | A | 8/1958 | Schutte |
| 2,848,039 | A | 8/1958 | Lenz |
| 2,877,832 | A | 3/1959 | Reavis |

(Continued)

FOREIGN PATENT DOCUMENTS

FR 2690322 10/1993

OTHER PUBLICATIONS

Stretch and Cover Brochure.

(Continued)

*Primary Examiner* — Rodney B White
(74) *Attorney, Agent, or Firm* — Foley & Lardner LLP

(57) ABSTRACT

A knit form-fit cover for a recliner chair having a base, a backrest, a seat, a pair of armrests and a footrest. The cover includes panels for covering the backrest, left and right armrests, the seat and the footrest. A seat panel includes a fastener having ends attached to lateral edges of the seat panel for positioning near a front edge of the seat of the recliner chair, which may be engaged to resistively fix a portion of the seat panel at the front edge of the seat. The seat panel is formed from an elasticized yarn material, and has pleated corners at lateral ends of a front edge of the seat panel for further securing the seat panel to the footrest. The seat panel also preferably has loops affixed to rear corners of the seat panel for securing a rear portion of the seat panel to the seat.

27 Claims, 9 Drawing Sheets

U.S. PATENT DOCUMENTS

| | | | | |
|---|---|---|---|---|
| 2,884,993 | A | 5/1959 | Schutte | |
| 2,921,625 | A | 1/1960 | Krasnov et al. | |
| RE25,133 | E | 3/1962 | Reavis | |
| 3,116,953 | A | 1/1964 | Sugarman | |
| 3,117,817 | A | 1/1964 | Mednick | |
| 3,311,408 | A | 3/1967 | Sarvas | |
| 3,589,770 | A | 6/1971 | Kelley | |
| 3,614,156 | A | 10/1971 | Sarvas | |
| 4,694,511 | A | 9/1987 | Estes et al. | |
| 5,275,463 | A | 1/1994 | Rocha | |
| 5,549,355 | A | 8/1996 | Illulian | |
| 5,626,388 | A | 5/1997 | Haltner | |
| 5,664,831 | A | 9/1997 | White et al. | |
| 5,664,832 | A | 9/1997 | Stevens et al. | |
| 5,676,422 | A | 10/1997 | White et al. | |
| 5,733,002 | A | 3/1998 | Riley et al. | |
| 5,836,645 | A * | 11/1998 | Sakaue et al. | 297/219.1 X |
| 6,116,685 | A | 9/2000 | White et al. | |
| 6,155,637 | A | 12/2000 | Waters | |
| 6,398,301 | B1 | 6/2002 | Illulian | |
| 6,659,550 | B2 | 12/2003 | Hackett | |
| 6,736,453 | B2 | 5/2004 | Chambers et al. | |
| 6,782,590 | B2 | 8/2004 | Rock et al. | |
| 6,796,609 | B2 | 9/2004 | Illulian | |
| 6,827,398 | B2 | 12/2004 | Nazginov | |
| 7,360,834 | B2 | 4/2008 | Miller et al. | |
| 7,377,585 | B2 | 5/2008 | Neustat | |
| 7,422,281 | B2 * | 9/2008 | Miller | 297/224 |
| 7,431,394 | B2 | 10/2008 | Neustat | |
| 7,472,954 | B2 | 1/2009 | Miller | |
| 2004/0155499 | A1 | 8/2004 | Chambers et al. | |
| 2006/0105658 | A1 | 5/2006 | Patz et al. | |
| 2008/0290705 | A1 | 11/2008 | Neustat et al. | |
| 2008/0315643 | A1 * | 12/2008 | Beroth et al. | 297/229 |

OTHER PUBLICATIONS

"www.surefit.net <http://www.surefit.net>", Reclining in Style. Brochure, 1997.

Maytex Mills, Inc. The Revolutionary Slipcover, Instruction Manual, Circa 2007.

Madison Industries, Inc. "Recliner Furniture Cover", Brochure, Circa 2007.

Texstyle Fashion & Design "Slipcover Stretch Recliner, Instructions for Stretch Recliner", Circa 2007.

www.stretchandcover.com <http://www.stretchandcover.com> "Stretch and Cover Expandables Slipcovers, 18—Recliner Slipcovers", 2005.

Stretch & Cover Expandable Slipcovers, The Only Ready-Made that Rivals Custom-Made, 2005 Stretch and Cover, Brochure, 2005.

Domestications Catalog; Recliner Cover Sets by SureFit, pp. 84-85, Circa 2003.

Stretch and Cover Instructions Sheet (2009, but believed to describe product of 2005).

* cited by examiner

KNIT FORM-FIT SLIPCOVER FOR A RECLINER

CROSS-REFERENCE TO RELATED APPLICATIONS

The present patent application is a continuation-in-part of U.S. patent application Ser. No. 11/285,916, filed on Nov. 23, 2005, now U.S. Pat. No. 7,422,281 B2 and entitled "Knit Form-Fit Slipcover," and claims priority under 35 U.S.C. §119(e) to U.S. Provisional Patent Application No. 60/976,204, filed on Sep. 28, 2007 and entitled "Knit Form-Fit Slipcover For A Recliner." The content of each of these applications is hereby incorporated by reference herein in its entirety.

FIELD OF THE INVENTION

The invention generally relates to furniture covers and, more specifically, to a knit form-fit slipcover for a recliner chair.

BACKGROUND

Furniture covers can be used to either protect furniture or as an economical solution to improving the aesthetics of damaged or unsightly furniture without reupholstering. There are furniture cover designs possible for all types of seating furniture. However, as the design of the chair becomes more complex, so too must the design of a cover adapted for that chair. One such complicated design is the recliner chair, which typically comprises a stationary base, a movable seat-backrest-footrest assembly, armrests and a linkage mechanism interconnecting the base and seat-backrest-footrest assembly. Most frequently, such recliner chairs are manually operable to move between reclining and upright positions in a variety of well known ways, such as, by pushing on the armrests, leaning backward against the backrest, manipulating a side handle, pressing down on an extended footrest, and so on.

Known slipcovers for recliner chairs include multi-piece slipcovers and one-piece slipcovers. U.S. Pat. No. 5,676,422, which is hereby incorporated by reference in its entirety herein, discloses a multi-piece recliner cover including a main body panel having a substantially rectangular shape, with first and second adjacent corners being notched to form a pair of V-cut slits that define a panel portion for covering the footrest of the recliner chair. In addition, separate skirts are provided covering the seat main body and the movable foot rest portion. The skirt for the main body is provided in the form of a longitudinal piece of material, while the other skirt is formed as a ring which fits the foot rest in the manner of a sleeve. While this configuration enables the slipcover to be effectively fit to a variety of recliner chairs of different sizes and shapes, a relatively complex and time consuming assembly is required to assemble the multiple pieces together to form the slipcover.

U.S. Pat. No. 5,664,832, which is also hereby incorporated by reference in its entirety herein, discloses a one-piece recliner cover made of a cross shaped fabric cover member having a head portion for engaging the backrest of the recliner, a foot portion for engaging the footrest of the recliner and a pair of arm portions for engaging the armrests of the recliner. A tube is provided at the outer ends of the armrest portions that receives an elastic belt or cord for engagement around the base of the recliner. A back panel is connected to one of the armrest portions for engagement around the back of the backrest and over a head portion of the backrest. Sufficient room is left in the seat which connects the head, foot and arm portion to each other for tucking around the recliner seat cushion. A tube for receiving a gripping member is provided at a junction between the head portion and the seat portion. The grip member can be pushed down into the crease between the back and the seat cushion to firmly stabilize the cover onto the recliner. While the slipcover is provided in a single piece, the various tucking and fastening operations required to apply the cover to the recliner chair are still somewhat complex and time consuming.

It would be of benefit to provide a single-piece slipcover that can be quickly fitted to a recliner chair having one of a variety of sizes and shapes, in a manner in which the slipcover effectively remains in its intended position on the recliner chair as the chair is operated and used by a user.

SUMMARY OF THE INVENTION

The present invention is directed to a knit form-fit slipcover for a recliner chair having a base, a backrest, a seat, a pair of armrests and a footrest. The cover includes panels for covering the backrest, left and right armrests, the seat and the footrest. The seat panel includes a fastener having ends attached to lateral edges of the seat panel for positioning near a front edge of the seat of the recliner chair, and which may be engaged to resistively fix a portion of the seat panel at the front edge of the seat. The seat panel also has pleated corners at lateral ends of a front edge of the seat panel to secure the seat panel to the footrest, and may also preferably have loops affixed to rear corners of the seat panel for securing the seat panel at a rear edge of the seat. The loops are configured to be attached to features of the recliner chair located below the seat.

The slipcover panels are preferably formed of a fabric that comprises an elastic yarn so that the cover can effectively fit and be secured to a variety of chairs having the same general design but not the exact same dimensions. The cover has an open bottom, and is pulled in place over the top of the chair. The elasticity in the fabric of the cover assists in positioning and placement by allowing the cover to expand or contract appropriately as it passes over the contours of the chair. The open bottom of the slipcover may preferably include an additional elastic member affixed to or enclosed at an edge at the open bottom for holding the cover securely in place on the chair.

One armrest panel may preferably include a slit for receiving a handle for operating the recliner chair, while the other armrest panel may preferably include a storage pocket positioned on an outwardly-facing portion of the panel to be conveniently reached by a user sitting in the recliner chair.

BRIEF DESCRIPTION OF THE FIGURES

These and other objects and features of the invention will become more apparent by referring to the drawings, in which like reference numerals delineate similar elements throughout the several views.

DETAILED DESCRIPTION OF THE PREFERRED EMBODIMENTS

Figure 1A:
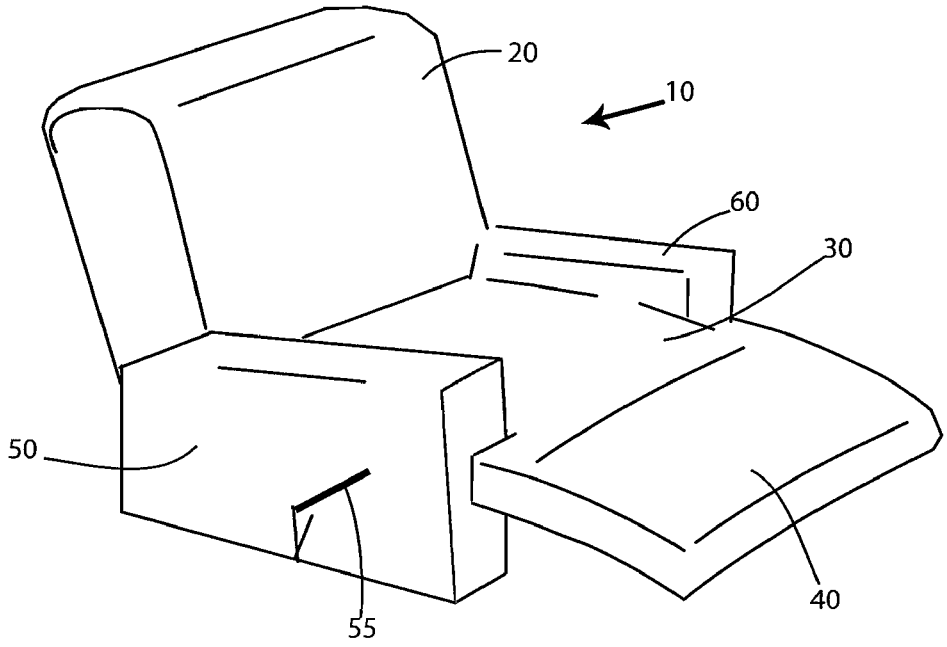
FIG. 1A provides a perspective view of a knit form-fit slipcover according to the present invention, as fitted to a recliner chair, as viewed from the front and left sides of the recliner chair.
Figure 1B:
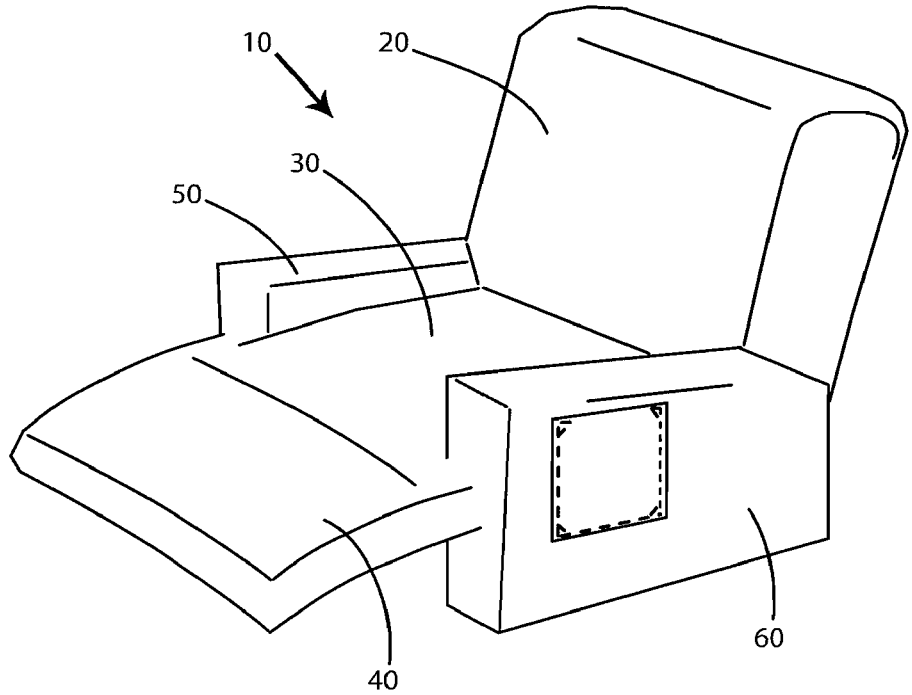
FIG. 1B provides a perspective view of the knit form-fit slipcover of FIG. 1A, as viewed from the front and right sides of the recliner chair.

The present invention is directed to a one-piece knit form-fit cover 10 for a recliner chair, a preferred embodiment of which is illustrated in FIGS. 1A, 1B. The cover 10 of FIGS. 1A, 1B includes a variety of panels which are assembled to provide a backrest portion 20, a seat portion 30, a footrest portion 40 and right and left armrest portions 50, 60 of the slipcover for covering the recliner chair.

Figure 2:
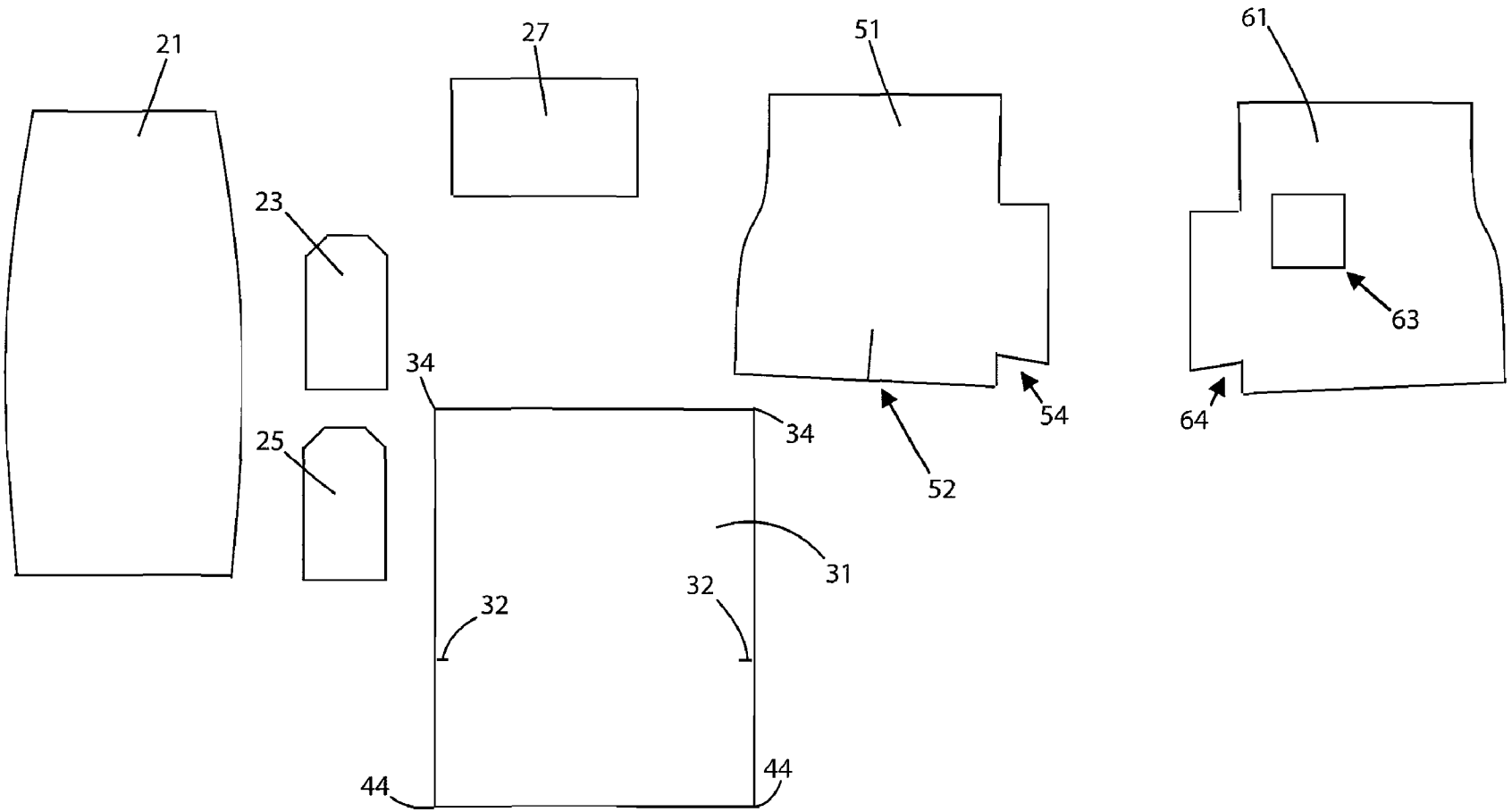
FIG. 2 provides a plan view of pattern components of the slipcover of FIGS. 1A, 1B.

FIG. 2 illustrates a preferred example of individual pattern components that may be assembled to produce the slipcover of FIGS. 1A, 1B. The backrest portion 20 is formed by a front panel 21, left and right shoulder panels 23 and 25, and a back panel 27. The seat portion 30 is formed by a seat panel 31, which is prepared with notches 32 and pleated corners 34 for receiving elastic loops (not shown) that are used to further secure the seat portion 30 to the seat of the recliner chair. Seat panel 31 also extends to provide the footrest portion 40, and includes pleated corners 44 for securing the seat panel 31 to the footrest of the recliner chair. Seat panel 31 may alternatively include a plurality of panels fixedly fastened by stitching, bonding or other suitable conventional fastening method.

The right armrest portion 50 is formed by right armrest panel 51, which may optionally include a slit 52 for receiving a side handle 55, as is illustrated in FIG. 1A, for moving the recliner chair between upright and reclining positions. Left armrest portion 60 is formed by left armrest panel 61, which may be preferably configured to include a pocket 63. Right and left armrest panels 51, 61 are each further notched at a front bottom corner for respectively forming pleated corners 54, 64 for securing the right and left armrest portions at a front most 50, 60 to the surfaces of the right and left armrest of the recliner chair, respectively.

While the above-described features have been presented for the purpose of understanding a preferred embodiment of the present invention as illustrated in FIGS. 1A, 1B, it should be understood that some of the described features may be modified to produce a slipcover that never-the-less remains within the intended scope of the present invention. For example, front and back panels 21, 27 may be modified to comprise a single backrest panel, slit 52 may be omitted or alternatively provided on left armrest panel 61, and pocket 63 may be omitted entirely from left armrest panel 61 or applied to another panel in the slipcover 10.

The present invention is preferably realized by using an elastic slipcover fabric having a stretch in length and a stretch in width which behave dynamically with respect to each other. In the preferred embodiment of FIGS. 1A and 1B, a fabric is used that has a minimum stretch in fabric width of 60%, and a minimum stretch in fabric length of 40%. The slipcover can be effectively form-fit to the recliner chair when the stretch in fabric width to 60% is thereafter reduced by 10%, and the stretch in fabric length to 40% is thereafter reduced by 25%. The cover may be accordingly fitted to a variety of recliner chairs having different shapes and sizes.

The slipcover fabric preferably has a minimum of 5% spandex or other suitable elastic fiber to provide the required stretch performance. A suitable testing method used for measuring the stretch properties of the slipcover fabric is outlined in the ASTM D 2594 testing standard[1]. Suitable stretch materials available commercially include, for example, CLEERSPAN and GLOSPAN by RadiciSpandex Corp. of Gastonia, N.C.; DORLASTAN by Asahi Kasei Europe GmbH of Dormagen, Germany; XLA by The Dow Chemical Company of Midland, Mich., ESP and LYCRA by INVISTA of Wichita, Kans., and REFLEXX by Uniti, Inc. of Greensboro, N.C.

[1] "Standard Test Method for Stretch Properties of Knitted Fabrics Having Low Power," ASTM D 2594, American Society for Testing and Materials, Dec. 1, 2004.

A process for assembling the various panels to form the slipcover 10 will next be described. For portions of the slipcover 10 that are fashioned from the elastic slipcover material, It is preferable to form the seams by stitching in a three-thread overlock pattern that will extend with the fabric as it is stretched.

Figure 3:
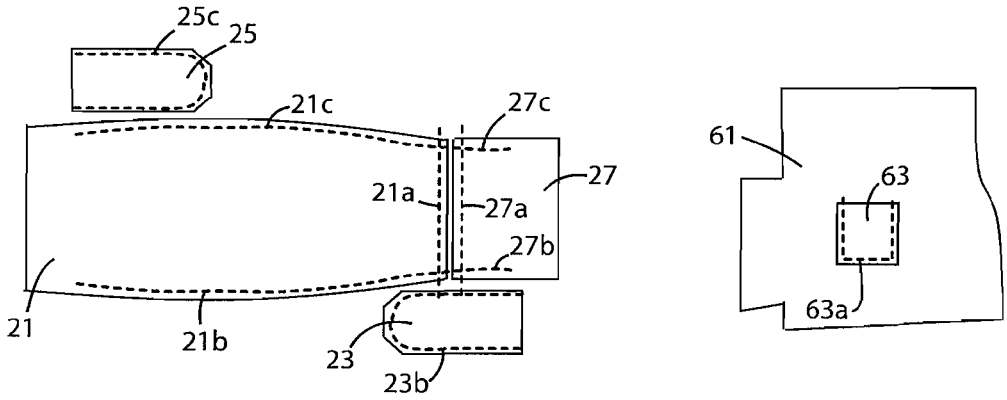
FIGS. 3-5 illustrate sewing sequences for assembling pattern components of FIG. 2 for covering the backrest and armrests of the recliner chair.

As shown for example in FIG. 3, in order to form the backrest portion 20, front panel 21 and back panel 27 are sewn to each other along seams 21*a* and 27*a*, left shoulder 23 is sewn to front panel 21 and back panel 27 along seams 23*b*, 21*b*, 27*b* and right shoulder 25 is sewn to front panel 21 and back panel 27 along seams 25*c*, 21*c*, and 27*c*. Also as shown in FIG. 3, pocket 63 is preferably sewn to left armrest panel 61 along seam 63*a*.

Figure 4:
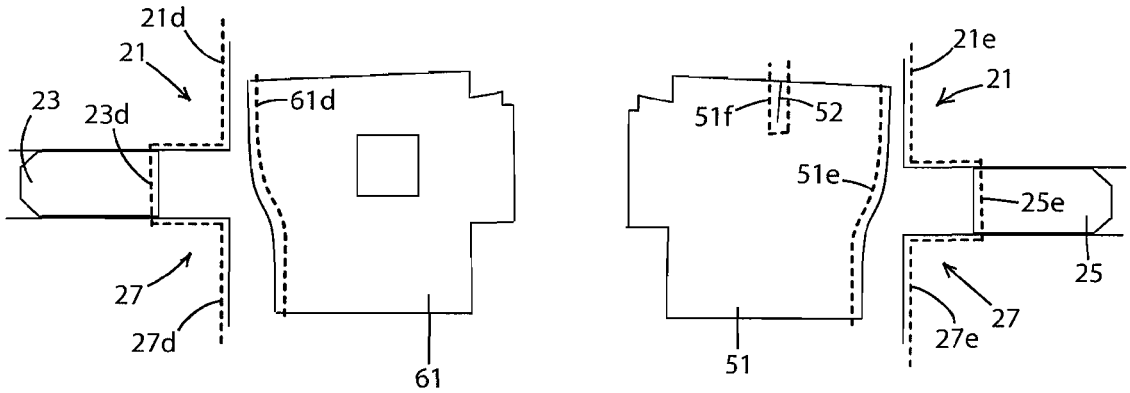

As shown in FIG. 4, left armrest panel 61 is fastened to front panel 21, left shoulder panel 23 and back panel 27 along seams 61*d*, 21*d*, 23*d* and 27*d*. Similarly, right armrest panel 51 is fastened to front panel 21, right shoulder panel 25 and back panel 27 along seams 51*e*, 21*e*, 25*e* and 27*e*. Slit 52 of left armrest panel 51 is reinforced by seam 51*f*.

Figure 5:
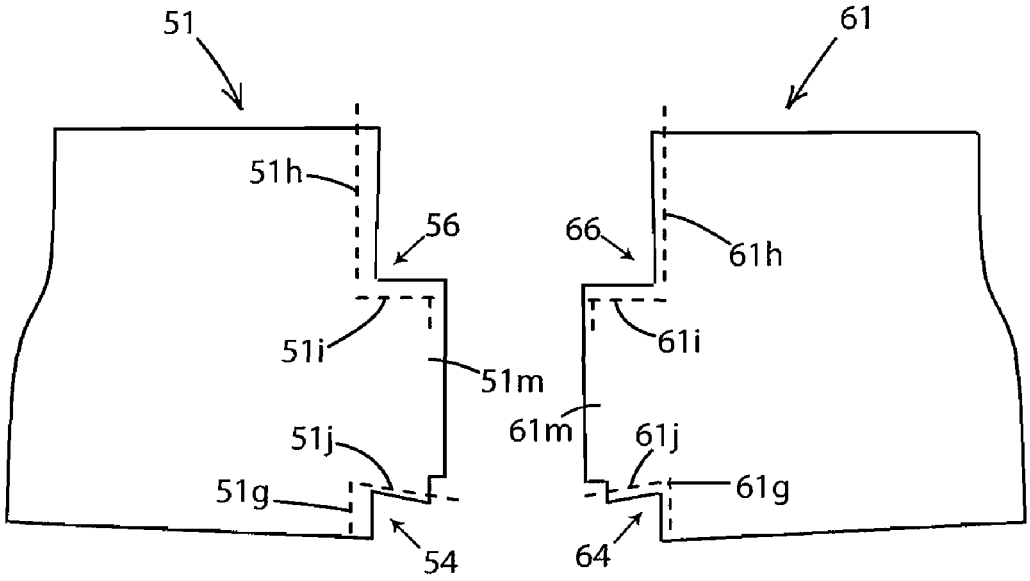

With further reference to FIG. 5, pleated corners 54, 64 for right and left armrest panels 51, 61 are respectively formed along seams 51*g*, 51*j* and 61*g*, 61*j*. Inside arm seams 56, 66 are respectively formed along seams 51*h*, 51*i* and 61*h*, 61*i*, which are joined by folding flaps 51*m*, 61*m* to shape the armrest panels 51, 61 for conformally fitting the associated armrests. Alternatively, flaps 51*m*, 61*m* may be replaced, for example, by separate arm front panels (not shown) that are joined to armrest panels formed without flaps.

Figure 6:
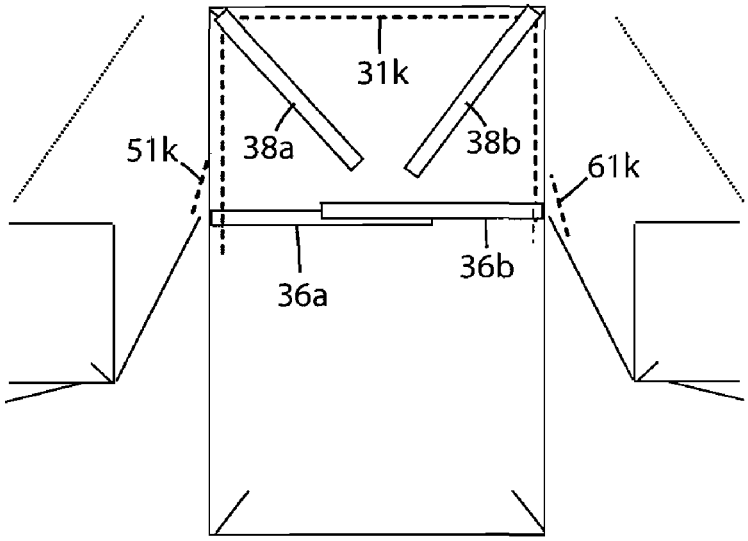
FIG. 6 illustrates a sewing sequence for assembling the seat and armrest pattern components of FIG. 2.

FIG. 6 illustrates the assembly of seat panel 31 to right and left armrest panels 51, 61 along seams 31*k*, 51*k* and 31*k*, 61*k*, respectively. Loops 36*a*, 36*b*, 38*a*, and 38*b*, which are used to secure the seat portion of the slipcover to the seat and are further described herein, may be preferably folded inwardly to permit the seat panel 31 and the right and left armrest panels 51, 61 to be joined, for example, by sewing.

Figure 7:
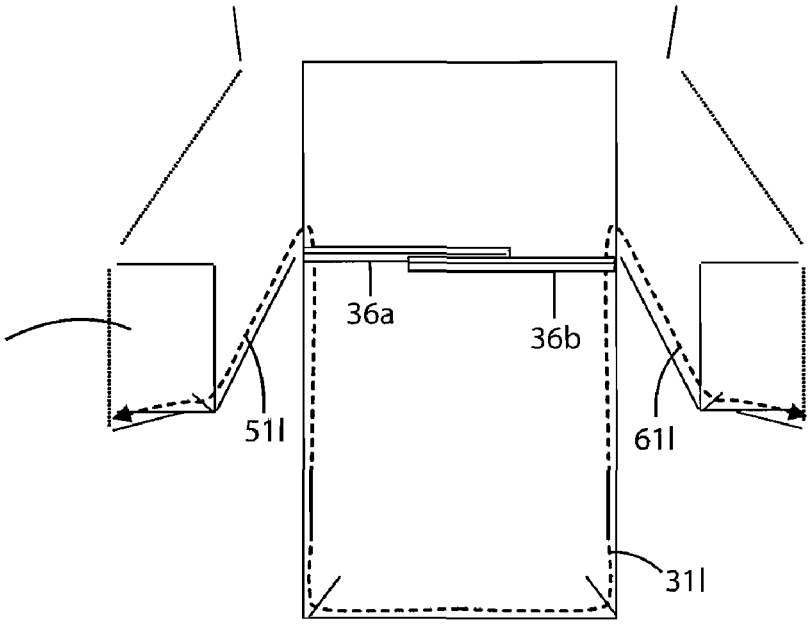
FIG. 7 illustrates a sewing sequence for attaching elastic to an open perimeter edge of the slipcover of FIGS. 1A, 1B for securing the perimeter edge at a base of the recliner chair.

Elastic may be provided at an open perimeter edge of the slipcover to further secure this portion of the slipcover to the base of the recliner chair. FIG. 7 illustrates seams 51*l*, 31*l* and 61*l* for securing the elastic to the open perimeter edges of the right armrest panel 51, seat panel 31 and left armrest panel 61, respectively. Elastic may also be provided and secured to an open perimeter edge of the back panel (not shown) to complete application of the elastic to the entire open perimeter.

The elastic may be secured in a variety of ways including, for example, by sewing the elastic directly to the perimeter edge. Alternatively, the perimeter edge may be sewn to form a tube at the perimeter edge for carrying the elastic around the edge. The elastic may be comprise a single, continuous piece that traverses the entire perimeter, or may include multiple pieces which may be snugged and tied off or otherwise fastened by one or more of a variety of conventional fastening systems (for example, by a fabric hook-and-loop fastener such as a VELCRO fastener) at one or more tie-off points around the perimeter.

Figure 8:
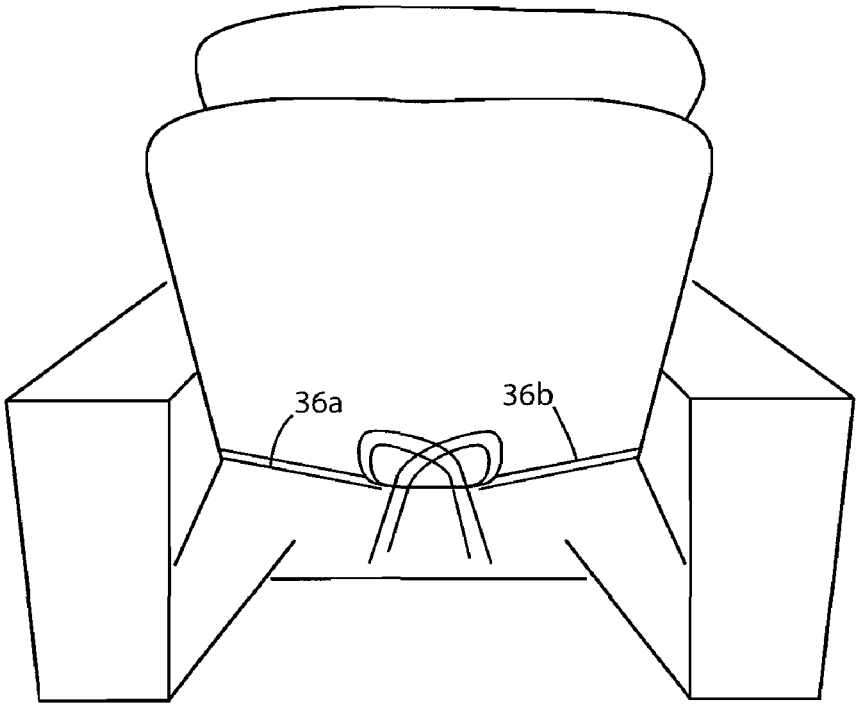
FIG. 8 illustrates an elastic loop arrangement for securing the slipcover of FIGS. 1A, 1B at a front edge of the seat of the recliner chair.
Figure 9:
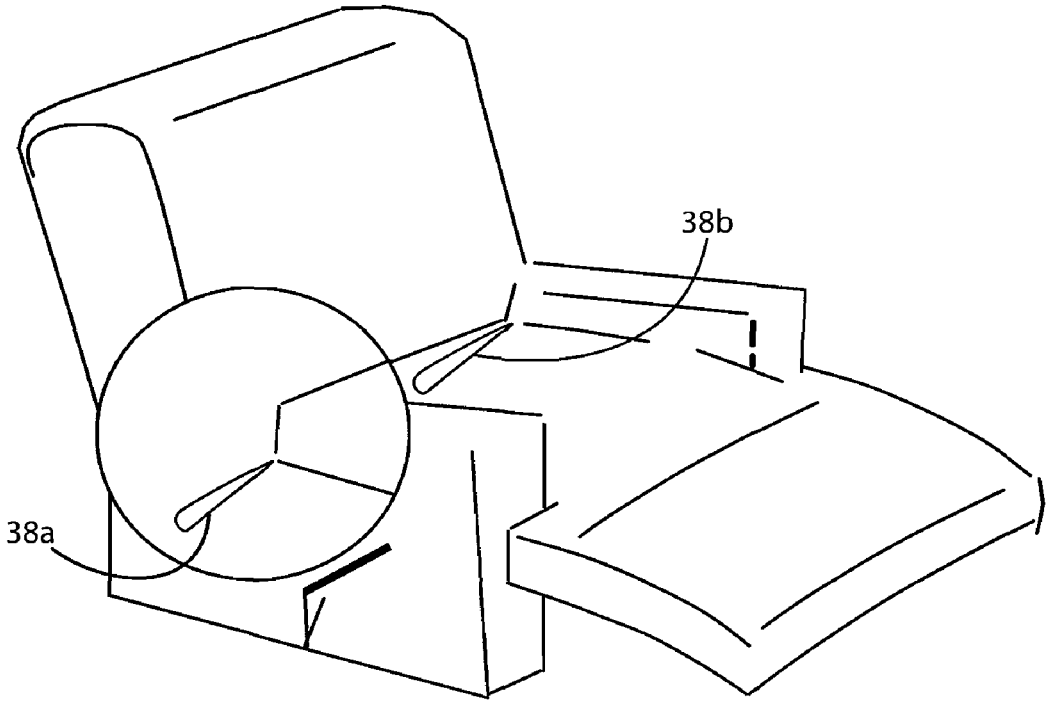
FIG. 9 provides another perspective view of the slipcover of FIGS. 1A, 1B that illustrates another elastic loop arrangement for securing the slipcover at a rear edge of the seat of the recliner chair.

FIGS. 8 and 9 illustrate several additional novel features used for securing the slipcover 10 to the recliner chair. FIG. 8 illustrates elastic loops 36*a*, 36*b*, which are provided at lateral edges of the seat panel 31 at a position such that the loops 36*a*, 36*b* can be fastened together beneath the seat of the recliner chair near a front edge of the seat. Loops 36*a*, 36*b* thereby secure the seat panel 31 at the front edge of the seat.

In addition, and as illustrated by FIG. 9, loops 38*a*, 38*b* may be attached at rear corners of the seat panel 31 to be pulled below the seat of the recliner chair to be secured to on or more internal features of the chair (for example, to legs of the chair).

In this manner, by means of the loops 36*a*, 36*b* and 38*a*, 36*b*, the slipcover 10 may in particular be firmly secured to the seat of the recliner chair. Because the seat of the recliner chair is a component subjected to a substantial degree of movement, this configuration provides a substantial advantage for avoiding undesired movement and displacement of the slipcover 10 relative to the seat.

Figure 10A:
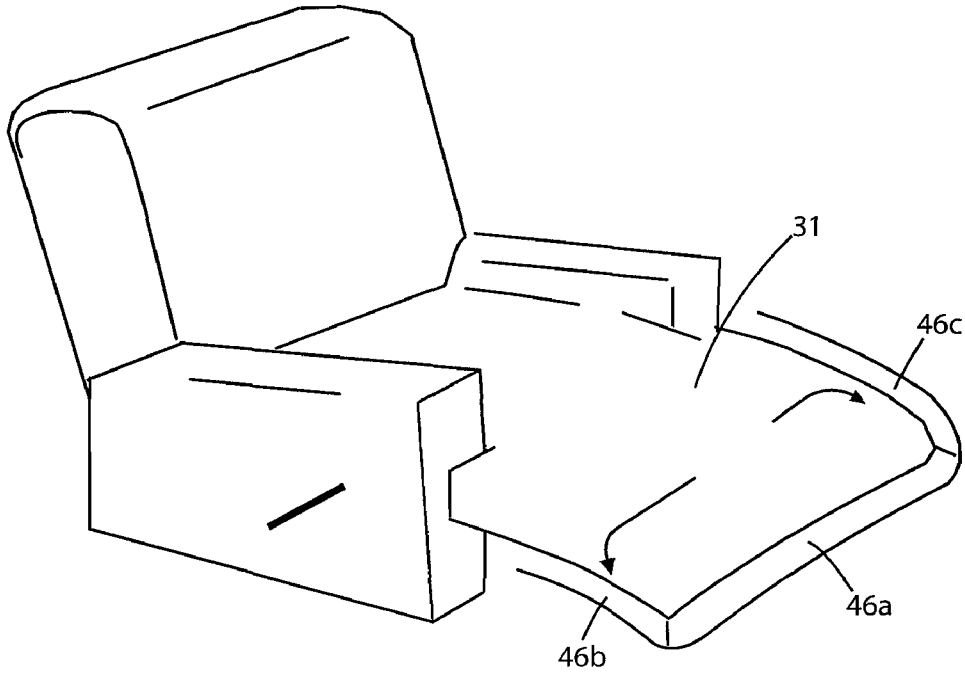
FIGS. 10A-10F illustrate the manner in which the slipcover of FIGS. 1A, 1B is applied to cover a recliner chair.
Figure 10B:
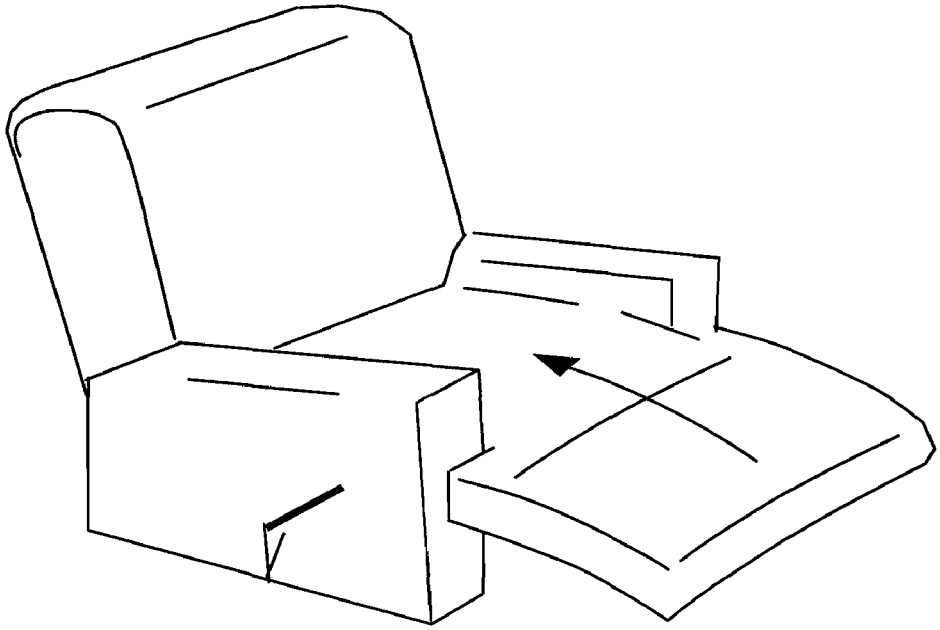
Figure 10C:
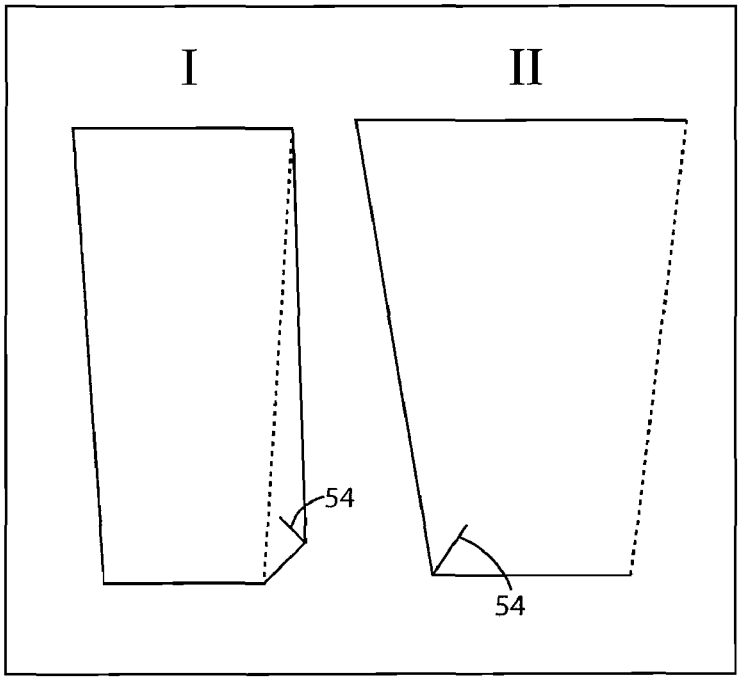

FIGS. 10A-10E illustrate steps in the process of fitting the inventive slipcover to the recliner chair. As illustrated in FIG. 10A, a forward end 46*a* and side ends 46*b*, 46*c* of the seat panel 31 in proximity to forward end 46*a* are stretched over the footrest of the recliner chair to form the footrest portion 40. Fastening is further facilitated by forming the pleated corners 44 and the elastic provided along seam 31*l* of FIG. 7. In FIG. 10B, the fabric in seat panel 31 is then smoothed rearwardly, with any excess material being tucked between rearward and sideward edges of the cushion of the seat and the backrest and armrest portions of the recliner chair, respectively.

At this time, right and left armrest panels 51, 61 are also positioned for a smooth fit against the right and left armrests. For example, and with reference to example I of FIG. 10C, when the right armrest 51 is relatively thin or small, pleated corner 54 may positioned at an interior bottom corner of a right armrest or the recliner chair. With reference to example II of FIG. 10C, when the right armrest is thicker or larger, pleated corner 54 may be moved as far out as an outer bottom front corner of the right armrest to accommodate the larger armrest and obtain the desired fit.

Figure 10D:
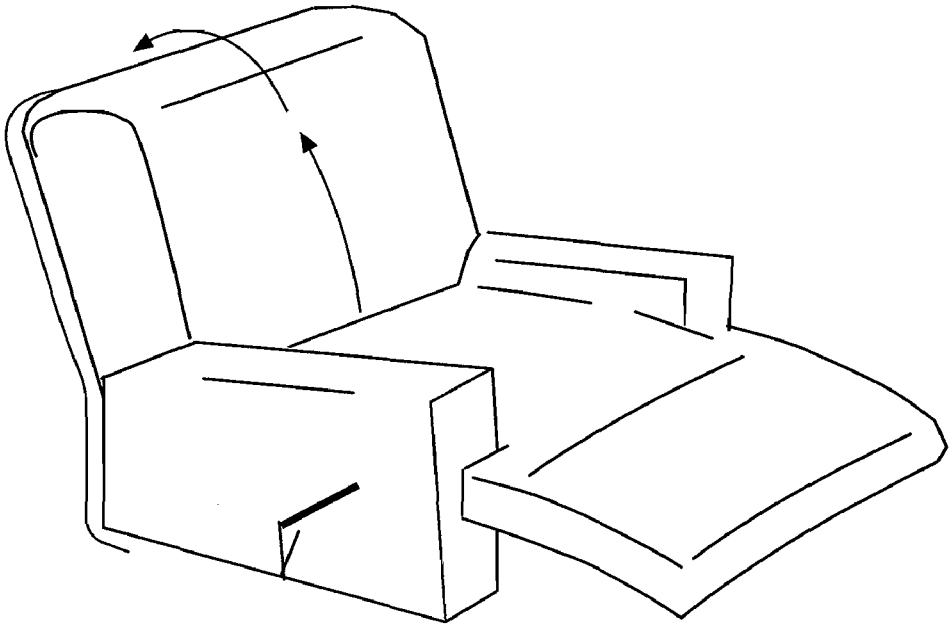

As illustrated in FIG. 10D, the backrest portion 20 is positioned over the backrest of the recliner chair, and smoothed from a region of the backrest portion 20 nearest the seat portion 30 over the top of the backrest toward the portion of the open perimeter at the bottommost part of the backrest portion 20. Excess material is thereby permitted to wrap underneath the base of the recliner chair under the urging of the elastic provided at the open perimeter edge of the slipcover.

Figure 10E:
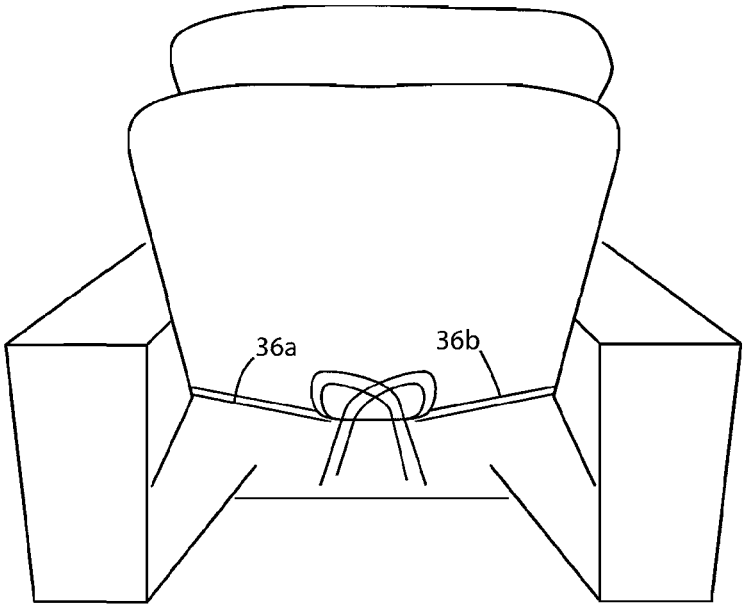
Figure 10F:
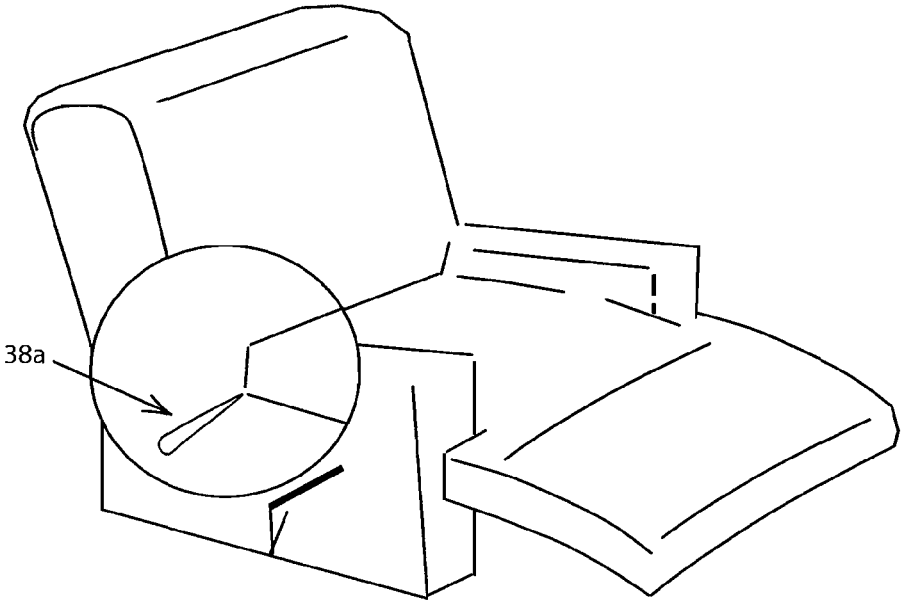

As illustrated in FIG. 10E (and earlier in FIG. 8), loops 36*a*, 36*b* are then fastened together at a front edge of the seat of the recliner chair to secure the seat panel 31 to the front edge of the seat of the recliner chair. As illustrated in FIG. 10F (and earlier in FIG. 9), loops 38*a*, 38*b* (the latter not being shown in FIG. 10F) attached at rear corners of the seat panel 31 are pulled around and below the seat of the recliner chair to be secured to the chair legs or to other internal features of the chair.

Although only a preferred embodiment of the invention has primarily been shown and described, many features may be varied, as were previously described and will readily be apparent to those skilled in this art. Thus, the foregoing description is illustrative and not limiting, and intended to include all reasonably foreseeable equivalents to the directly described features within the scope of invention as defined herein by the claims. It is also to be understood that the drawings are not necessarily drawn to scale but that they are merely conceptual in nature. It is the intention, therefore, for the invention to be limited only as indicated by the scope of the claims appended hereto.

What is claimed is:

1. A slipcover for a recliner chair having a base, a backrest, a seat, left and right armrests and a footrest, wherein the backrest, seat and footrest are coordinatedly movable, the slipcover comprising:

backrest portion including one or more fabric panels for covering the backrest;

left and right armrest portions each including one or more fabric panels for respectively covering the left and right armrests;

a seat and footrest portion for covering at least a seating surface of the seat and the footrest, the seat and footrest portion including at least one fabric panel;

a first fastener having an end that is attached at a first lateral edge of the seat and footrest portion in proximity to a front edge of a seat portion of the seat and footrest portion; and a second fastener having an end that is attached at a second lateral edge of the seat and footrest portion in proximity to the front edge of the seat portion of the seat and footrest portion, wherein the first fastener and second fastener are configured to be selectively secured to one another beneath the seating surface of the seat of the recliner in order to resistively fix a portion of the seat and footrest portion to the seating surface at a front edge of the seat of the recliner.

2. The slipcover according to claim 1, wherein the at least one fabric panel of the seat and footrest portion further comprises:

pleated corners provided at lateral ends of a front edge of the at least one fabric panel, and an elastic member secured to at least a front edge of the seat and footrest portion of the at least one fabric panel and to the lateral edges of the seat and footrest portion, wherein the pleated corners and elastic members are configured to resistively fix the seat and footrest portion to the recliner.

3. The slipcover according to claim 2, wherein:

the first fastener and second fastener are formed by extending the elastic member to form loops at each of the lateral edges of the seat and footrest portion.

4. The slipcover according to claim 1, wherein the at least one fabric panel of the seat and footrest portion further comprises:

pleated corners at lateral ends of a rear edge of the seat and footrest portion; and an elastic member secured to at least a rear edge of the seat and footrest portion and to the lateral edges of the seat and footrest portion for securing the seat portion to the seat.

5. The slipcover according to claim 1, wherein the at least one fabric panel of the seat and footrest portion further comprises:

a left pleated corner at a left lateral end of a rear edge of the seat and footrest portion;

a right pleated corner at a right lateral end of a rear edge of the seat and footrest portion;

a first loop having an end that is attached at the left pleated corner; and a second loop having an end that is attached at the right pleated corner, wherein the first loop and second loop are configured to be selectively attached to features of the recliner chair provided below the seat in order to resistively fix a portion of the seat and footrest portion to the seating surface at the rear edge of the seat.

6. The slipcover according to claim 5, wherein the first loop and second loop are configured to be selectively attached to legs of the recliner chair.

7. The slipcover according to claim 5, wherein the first loop and second loop are provided by extending an elastic member secured to a front edge of the seat and footrest portion of the at least one fabric panel and to the lateral edges at the seat portion to form loops at each of the pleated corners at the rear edge of the at least one fabric panel.

8. A slipcover for a recliner chair having a base, a backrest, a seat, left and right armrests and a footrest, wherein the backrest, seat and footrest are coordinatedly movable, the slipcover comprising:

a backrest portion including one or more fabric panels for covering the backrest;

left and right armrest portions each including one or more fabric panels for respectively covering the left and right armrests; and seat and footrest portions for respectively covering the seat and the footrest, the seat and footrest portions together including at least one fabric panel; and fasteners in the seat portion, the fasteners having ends that are attached at one or more of lateral edges and corners of the at least one fabric panel of the seat and footrest portions, the fasteners being configured to resistively fix a portion of the at least one fabric panel to the recliner, wherein one or more of the fabric panels comprises a textile material providing at least a 40% fabric stretch in pattern width and at least a 60% fabric stretch in pattern length under ASTM D 2594 stretch testing.

9. The cover according to claim 8, wherein the textile material comprises an elasticized yarn material.

10. The cover according to claim 9, wherein the elasticized yarn material comprises a spandex material.

11. The slipcover according to claim 8, wherein each of the fabric panels comprises the material providing at least a 40% fabric stretch in pattern width and at least a 60% fabric stretch in pattern length under ASTM D 2594 stretch testing.

12. The cover according to claim 1, wherein the first fastener and second fastener are configured to be selectively secured to one other by a hook and loop fastening material.

13. The cover according to claim 1, wherein the first fastener and second fastener are configured to be selectively secured to one another by tying the first fastener to the second fastener.

14. The cover according to claim 1, wherein one of the left and right armrest panels includes a slit configured for receiving a handle of the recliner chair.

15. The cover according to claim 1, wherein one of the left and right armrest panels includes a storage pocket.

16. A method for manufacturing a slipcover for a recliner chair having a base, a backrest, a seat, left and right armrests and a footrest, wherein the backrest, seat and footrest are coordinatedly movable, the method comprising the steps of:

forming a backrest portion for covering the backrest;

forming left and right armrest portions for respectively covering the left and right armrests;

forming a seat and footrest portion for covering at least a seating surface of the seat and the footrest, joining rear edges of each of the left and right armrest portions to opposing lateral edges of the backrest portion and the seat and footrest portion;

providing a first fastener and attaching an end thereof at a first lateral edge of the seat and footrest portion in proximity to a front edge of a seat portion of the seat and footrest portion;

providing a second fastener and attaching an end thereof at a second lateral edge of the seat and footrest portion in proximity to the front edge of the seat portion of the seat and footrest portion;

wherein the first fastener and second fastener are configured to be selectively secured to one another beneath the seating surface of the seat of the recliner in order to resistively fix a portion of the seat and footrest portion to the seating surface at a front edge of the seat of the recliner.

17. The method according to claim 16, comprising the steps of:

providing pleated corners at lateral ends of a front edge of the seat and footrest portion, and providing an elastic member secured to at least the front edge of the seat and footrest portion and the lateral edges at the footrest portion, wherein the pleated corners and elastic members are configured to resistively fix the seat and footrest portion to the recliner.

18. The method according to claim 17, wherein:

the step of providing the first fastener further includes the step of forming the first fastener by extending the elastic member to form a loop the first lateral edge of the seat and footrest portion; and the step of providing the second fastener further includes the step of forming the second fastener by extending the elastic member to form a loop at the second lateral edge of the seat and footrest portion.

19. The method according claim 16, further comprising the steps of:

providing pleated corners at lateral ends of a rear edge of the seat and footrest portion; and providing an elastic member secured to at least the rear edge of the seat and footrest portion and to the lateral edges at the seat portion, wherein the pleated corners and elastic members are configured to resistively fix the seat and footrest portion to the seat of the recliner.

20. A method for manufacturing a slipcover for a recliner chair having a base, a backrest, a seat, left and right armrests and a footrest, wherein the backrest, seat and footrest are coordinatedly movable, the method comprising the steps of:

forming a backrest portion for covering the backrest;

forming left and right armrest portions for respectively covering the left and right armrests;

forming seat and footrest portions for respectively covering the seat and the footrest;

joining rear edges of each of the left and right armrest portions to opposing lateral edges of the backrest portion and the seat portion; and providing fasteners having ends secured at the lateral edges of the seat portion, the fasteners being operable to resistively fix an area of the seat portion to the recliner, wherein the forming steps further comprise the step of:

providing one or more fabric panels to form one or more of the backrest, armrest, and seat and footrest portions, the one or more fabric panels each comprising a textile material providing at least a 40% fabric stretch in pattern width and at least a 60% fabric stretch in pattern length under ASTM D 2594 stretch testing.

21. A slipcover for a piece of furniture comprising:

a base;

a back; and a seat portion, wherein the slipcover includes at least one fabric panel for each of the base, the back and the seat portion, the at least one base panel, the at least one back panel and the at least one seat panel being assembled to form the slipcover, and wherein each of the at least one base panel, the at least one back panel and the at least one seat panel comprises a textile material that exhibits a stretch in length which behaves dynamically with respect to a stretch in width, wherein the stretch in fabric width is at least 60% under ASTM D 2594 testing.

22. The slipcover of claim 21, wherein the stretch in fabric length is at least 40% under ASTM D 2594 testing.

23. The slipcover of claim 21, wherein each fabric panel of the base, the back and the seat portion is configured to remain stretched in both width and length directions after the slipcover is form-fit to the furniture.

24. The slipcover of claim 21, wherein the slipcover is patterned to fit at least one arm of the furniture, the slipcover further comprising:

at least one arm panel, the at least one arm panel being assembled with the at least one base panel, the at least one back panel and the at least one seat panel to form the slipcover, wherein the at least one arm panel has a stretch in length which behaves dynamically with respect to a stretch in width, wherein the stretch in fabric width in the at least one arm panel is at least 60% under ASTM D 2594 testing.

25. The slipcover of claim 24, wherein the stretch in fabric length in the at least one arm panel is at least 40% under ASTM D 2594 testing.

26. A method for assembling a slipcover for a piece of furniture, the method comprising the steps of:

preparing a seat platform panel, two arm side panels, two arm front panels, a back panel and a plurality of seat cushion panels from a material that has a stretch in length which behaves dynamically with respect to a stretch in width, wherein the stretch in fabric width is at least 60% under ASTM D 2594 testing;

securing each arm side panel to one of the two side edges of the back panel;

securing each arm front panel to one of the two arm side panels;

securing a rear edge of the seat platform to the front edge of the back panel, and securing side edges of the seat platform are to the arm side panels and to the arm front panels.

27. The method of claim 26, wherein the stretch in fabric length is at least 40% under ASTM D 2594 testing.

* * * * *